United States Patent [19]

Warwick

[11] 4,015,393

[45] Apr. 5, 1977

[54] PANEL WITH CORE AND METHOD OF CONSTRUCTING

[76] Inventor: Charles Herbert Warwick, 1800 SW. North Shore Road, Lake Oswego, Oreg. 97034

[22] Filed: June 4, 1973

[21] Appl. No.: 366,340

[52] U.S. Cl. ..... 52/615; 52/475

[51] Int. Cl.[2] ..... E04B 2/28

[58] Field of Search ..... 52/615, 743, 309, 475

[56] References Cited

UNITED STATES PATENTS

| | | | |
|---|---|---|---|
| 2,243,022 | 5/1941 | Thomas | 52/615 |
| 2,607,960 | 8/1952 | Olsson | 52/400 |
| 3,165,792 | 1/1965 | Pick | 52/615 |
| 3,225,505 | 12/1965 | Lytz | 52/615 |
| 3,401,495 | 9/1968 | Schneller | 52/615 |
| 3,462,897 | 8/1969 | Weinrott | 52/615 |

*Primary Examiner*—Price C. Faw, Jr.

*Attorney, Agent, or Firm*—Kolisch, Hartwell, Dickinson & Stuart

[57] ABSTRACT

A panel such as a door having a fire-resistant core and a frame encompassing the edge margins of the core. A method of making such a panel wherein the frame is prepared of frame portions which are united together in the frame. A method of forming the core in place within a frame, with the introduction of a hardenable material to within the confines of a frame, and permitting such material then to harden. A door skin or other covering is adhesively secured in place over faces of the panel.

3 Claims, 6 Drawing Figures

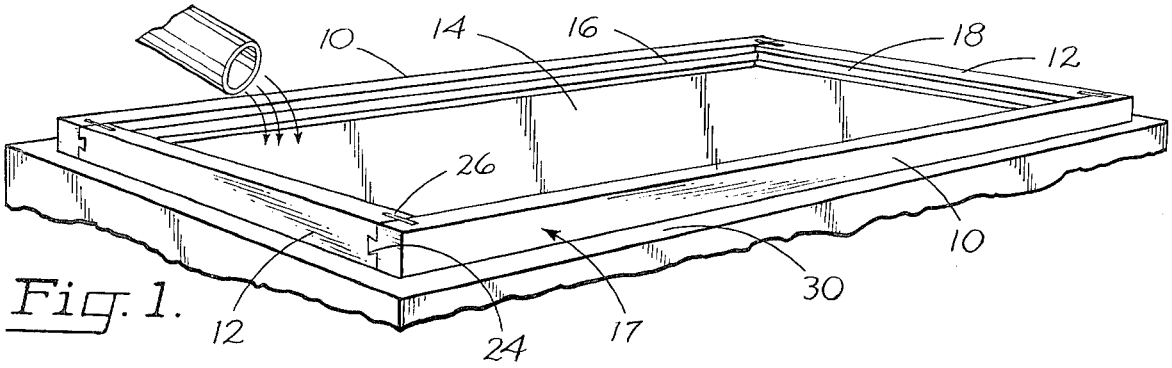
Fig. 1.
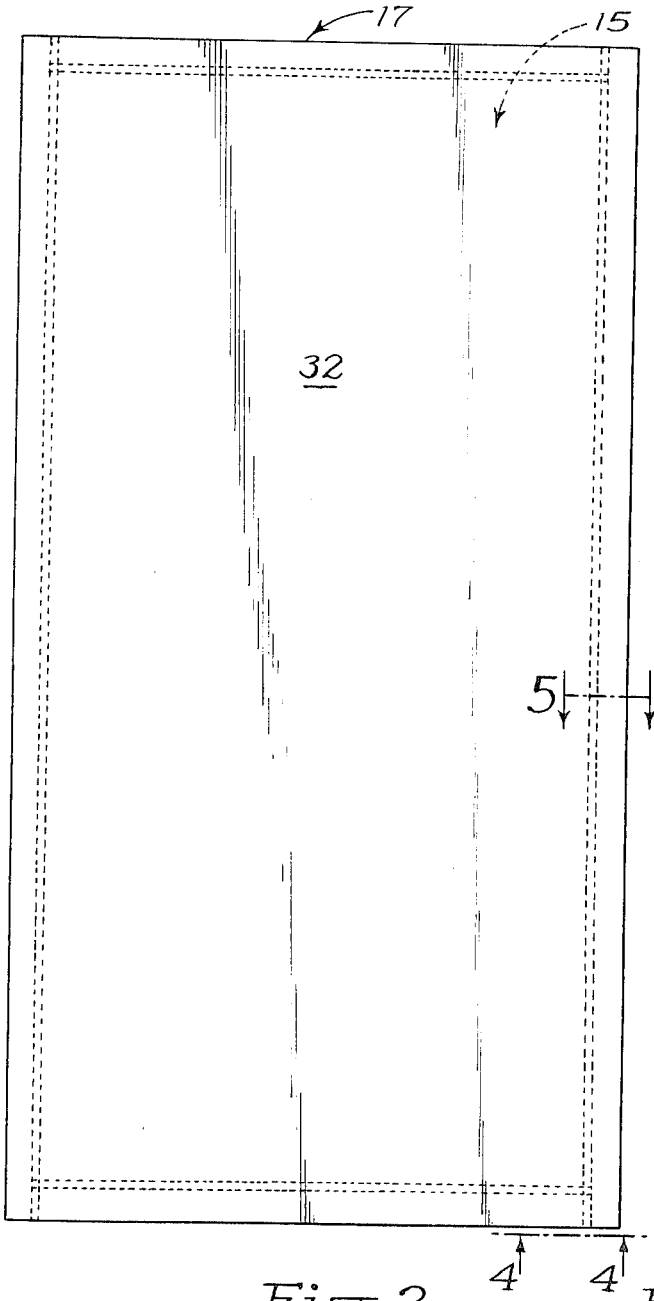
Fig. 2.
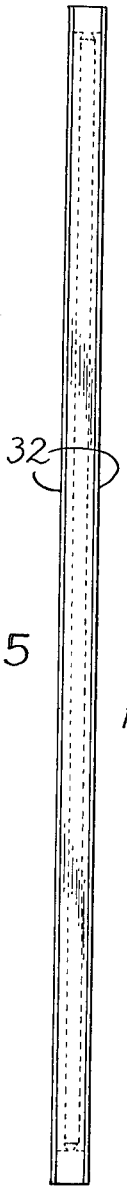
Fig. 3.
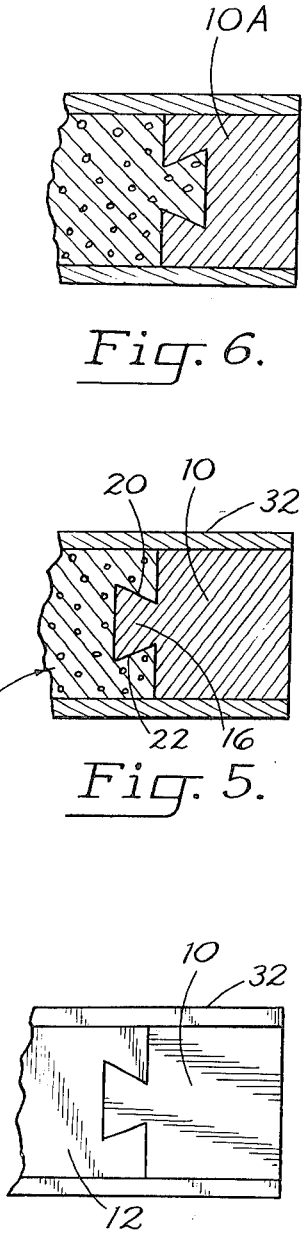
Fig. 6.
Fig. 5.
Fig. 4.

PANEL WITH CORE AND METHOD OF CONSTRUCTING

This invention relates to panel construction, and more particularly to a panel such as a door which includes a fire-resistant core encompassed by a surrounding frame in the panel.

So-called fireproof doors are becoming increasingly used in the construction of apartment buildings and other complexes, as required by different fire codes and regulations, to inhibit the spread of fire should such accidentally break out.

A fireproof door as presently constructed may comprise a slab of mixtures of gypsum, perlite, cement, mica, asbestos and other materials, selected for noncombustibility, which forms a core in the door. In making the door, side and end rails are glued or otherwise bonded to the peripheral margins of the slab. Coverings are then applied to opposite sides of the door which serve as facings.

There are a number of disadvantages involved in constructing a door in this manner. For one thing, the slab of noncombustible material which forms the core must be handled extremely carefully to avoid breaking it, or other damage. When the side and end rails are applied, it is difficult adequately to adhere these to the edge margins of the noncombustible core. Usually, an extended curing time is required in adhering the side and end rails, dictating the use of clamps and other devices to hold the side and end rails in place, which is inconvenient and expensive. The ultimate bond usually produced is quite weak, since gypsum material, for instance, has little tensile strength, and the rails tend to break away from the edge margins. Aside from difficulties encountered in manufacture, the door itself is not entirely satisfactory. Thus, under continued use, and with slamming of a door, there may be separation of the core from the surrounding frame. Furthermore, under the conditions of a fire, separation of a core margin from an abutting margin of the frame produces a crack through which hot air and flames may travel, with resultant burning of the door margin and premature destruction of the door resulting.

This invention has for one of its objects the provision of a novel method of manufacturing a door or like panel, featuring a fire-resistant core which is formed in place.

Another object is to provide a method of manufacturing such a panel, where the core is formed in place in such a manner that after the core has been formed, it is mechanically locked within an encompassing frame.

A further object is to provide a method wherein the frame that encompasses the core has superior strength, in addition to being mechanically locked to the core bounded thereby.

Yet another object of the invention is the provision of a method for making a panel which eliminates the necessity for handling core pieces prior to their incorporation within a frame.

Another object is to provide a unique form of panel construction, featuring a core which through a mortise and tenon fit is secured in place within the confines of a frame.

These and other objects and advantages are attained by the invention described herein, as will become more fully apparent from the following description, which is to be read in conjunction with the accompanying drawings, wherein:

FIG. 1 is a perspective view showing how the core is formed in place within the frame of a door;

FIG. 2 is a front view of a door as constructed herein;

FIG. 3 is an edge view of the door shown in FIG. 2;

FIG. 4 is a view of a corner in the door taken along the line 4—4 in FIG. 2;

FIG. 5 is a cross-sectional view taken along the line 5—5 in FIG. 2; and

FIG. 6 is a view similar to FIG. 5 but showing another modification of the invention.

Referring initially to FIGS. 2, 3, and 5, a door constructed according to one embodiment of the invention includes a core 15, and bounding the core a frame 17. The core is of fire-resistant material. The frame may be made of wood, treated for fire resistance if desired, and is utilized in the hanging of the door through the mounting of hinges and the mounting of other hardware usually associated with a door. Opposite faces of the door or panel comprise coverings, such as those indicated at 32, which may be veneers, thin plywood skins, etc. These are adhesively bonded to opposite faces of the assembly comprising the core and frame.

Frame 17 comprises opposed side rails, or rail members, 10, and opposed end rails, or end rail members, 12. As perhaps best illustrated in FIG. 1 which shows the frame before the introduction of the core material, the side and end rails, along the sides of these members which face inwardly in the assembled frame, are provided along their length with elongate ridges 16, 18, respectively, referred to as tenon ridges. These ridges, preferably, as illustrated by ridge 16, shown in FIG. 5, are bounded by sides, such as side 20, 22, that diverge from each other viewing a cross section of a member and progressing outwardly on the member.

In the making of a frame, it has been found expedient to join the end of one of the members, such as member 10 shown in FIG. 1, with the member 12 which forms a corner with member 10, by extending member 10 across the extreme end of member 12. The extreme end of member 12 is cut out or shaped with a slot 24 extending across it having a cross sectional shape which matches the cross sectional shape of ridge 16. In this way, with the side and end rails assembled to form a corner, a mortise and tenon type joint is prepared at the corner, with an end portion of ridge 16 snugly received within the slot 24 of the end rail member 12. By reason of the slope of the sides of a ridge, the joint which is specifically prepared is a dovetail joint.

In finally securing a side and end rail at a corner, a fastener such as the staple 26 may be employed as shown in FIG. 1. If desired, an adhesive can also used at a corner.

The frame which is prepared in the manner set forth is very rigid by reason of the joints present at the corners of the frame. Those portions of the tenon ridges which are exposed on the inside of the frame are further utilized in the mounting of the core, which is prepared whereby such is mechanically locked within the confines of the frame.

Further explaining, the frame may be deposited on a flat supporting surface, such as the one shown at 30 in FIG. 1. A hardenable plastic material having fire-resistant properties is then introduced into the void shown at 14 which is bounded by the frame as by pouring such material downwardly into the void where such opens up to the top of the frame. A number of different types of materials may be utilized in the production of the core. Materials that suggest themselves for such use comprise various mixtures of selected materials such as gypsum, perlite, cement, mica, asbestos, etc. The material includes sufficient water or other vehicle to produce from the mix a general plastic consistency. The material is hardenable, in that after a period of time, and considering a mixture containing the usual Portland cement, such sets or solidifies to form a rigid slab.

With the introduction of such plastic material to void 14, such tends to spread out completely to fill the void. The material furthermore is introduced in sufficient quantity to overfill slightly the void, so that such extends slightly above the level of the top side of the frame as illustrated in FIG. 1. The material, while still in a plastic state, may then be worked as by vibrating or shaking the frame as it is supported on surface 30, and by troweling or puddling the top of the cementitious material, to ensure that the material works into the corners of the void and over and under the sides of ridges 16, 18, whereby they become completely enveloped with the plastic material.

After the introduction of such material and the passage of time, and with hardening of the material, an integrated panel is produced comprising the encompassing frame and a central core, with the core locked in place by reason of the ridges which become embedded in the edge margins of the core. The core when it hardens is formed with elongate mortise grooves matching in profile the tenon ridges and snugly receiving these ridges where such extend along the inside of the frame. The frame and core are easily handled as one piece, with the frame during such handling strengthening the core to protect the same from damage.

After the production of the core within the frame, it is contemplated that the assembly may be finished as by sanding its opposite faces. This serves to produce smooth, completely flat opposite faces in the core which are flush and join smoothly with the surfaces of the side and end rail members that lie in the plane of the core.

In the manufacture of a door, the assembly after sandjing then may have adhesively secured to its opposite faces coverings which may be veneer, thin plywood skins, etc. After the application of the coverings, outer surfaces may be coated with sealant, varnish or other coatings depending upon the particular installation of the door.

With the door or panel constructed as indicated it will be seen that a number of desirable properties result. The frame that is utilized in preparing the core in place is characterized by a very rigid construction. The core, after such has been prepared, is reinforced by the encompassing frame with the resulting core and frame assembly being relatively easily handled without fear of damage to the core. The core and frame are Mechanically locked together, more specifically, by a dovetail type mortise and tenon joint extending along each edge margin of the core. In this way, separation of the frame from a margin of the core even under conditions of a fire is inhibited.

In FIG. 6, there has been illustrated in cross section portions of a door or panel constructed according to a modification of the invention. In this instance, the side and end rail members, as exemplified by side rail member 10A shown in FIG. 6, may be prepared with elongate mortise grooves extending along their length and facing inwardly with the frame assembled. According to this modification of the invention, at each corner of the door, the side rail member 10A, as in the first embodiment of the invention, extends across the extreme end of the end rail member which forms a corner therewith. With the modification of FIG. 6, however, the extreme end of the end rail member is shaped, not with a slot such as slot 24 discussed earlier, but with a tenon which matches the cross-sectional profile of the mortise groove where such extends across the end rail member. A mortise and tenon dovetail-type joint again may be prepared at each corner of the frame.

With the modification of the invention shown in FIG. 6, with the plastic material which forms the core introduced within the confines of the frame, such is made to fill up the mortise grooves which extend about the inner perimeter of the door frame. When the material hardens, or sets, the resultant core which is produced along its end and side margins is formed with a tenon ridge which fits within and complements the mortise grooves of the various side and end rail members.

It should be obvious that certain changes and variations are possible in practicing the instant invention other than those specifically discussed herein. It should be understood, therefore, that what has been discussed herein are preferred modifications of the invention and by indicating such it is not intended to exclude modifications or approaches which produce the invention as herein defined.

It is claimed and desired to secure by Letters Patent:

1. A panel comprising an outer frame of side and end rail members joined together at corners with mortise and tenon joints, and a core of fire-resistant material within and bounded by said frame, a joint in said frame including a tenon portion presented by and an integral part of one of said rail members fitting within a mortise portion presented by an an integral part of another of said rail members, and at least one of said portions being part of a continuous expanse of like cross-sectional profile extending along the rail member which presents the portion, along that side of the rail member which faces said core, said core having an edge margin extending alongside said continuous expanse which lies against and is shaped to have a locking fit with said continuous expanse said mortise and tenon portions having a shape forming a dovetail joint, and the locking fit of said edge margin of said core with said continuous expanse being a dovetail fit.

2. The panel of claim 1, wherein said one of said portions is a dovetail tenon portion, said continuous expanse comprises an elongate tenon ridge extending along the rail member.

3. A panel comprising an outer frame including side and end rail members joined together at corners, said members having edge margins facing inwardly bounding a core space, and a core of fire-resistant material in said core space bounded by said frame, said core having edge margins facing outwardly and an outwardly facing edge margin in said core being in opposing relation to an inwardly facing edge margin of said frame.

an opposing set of edge margins in said panel including one edge margin having an elongate tenon ridge of dovetail cross section extending therealong which is an integral part of the edge margin and another edge margin having an elongate mortise groove of dovetail cross section extending therealong which is an integral part of the edge margin, said tenon ridge fitting with said mortise groove and serving mechanically to lock the core within the frame.

* * * * *

UNITED STATES PATENT AND TRADEMARK OFFICE

CERTIFICATE OF CORRECTION

PATENT NO. : 4,015,393

DATED : April 5, 1977

INVENTOR(S) : Charles Herbert Warwick

It is certified that error appears in the above-identified patent and that said Letters Patent are hereby corrected as shown below:

In Column 4, line 40, change "an"(first occurrence) to -- and --.

In Column 4, line 65, after "frame" the period should be a comma.

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*